US010385860B2

(12) United States Patent
Drechsel et al.

(10) Patent No.: US 10,385,860 B2
(45) Date of Patent: Aug. 20, 2019

(54) PUMP ARRANGEMENT FOR DRIVING AN IMPELLER USING AN INNER ROTOR WHICH INTERACTS WITH AN OUTER ROTOR AND THE OUTER ROTOR HAVING A RADIALLY OUTER CIRCUMFERENTIAL PROJECTION

(71) Applicant: KSB Aktiengesellschaft, Frankenthal (DE)

(72) Inventors: Patrick Drechsel, Frankenthal (DE); Markus Lay, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 340 days.

(21) Appl. No.: 14/893,367

(22) PCT Filed: May 19, 2014

(86) PCT No.: PCT/EP2014/060197
§ 371 (c)(1),
(2) Date: Nov. 23, 2015

(87) PCT Pub. No.: WO2014/187761
PCT Pub. Date: Nov. 27, 2014

(65) Prior Publication Data

US 2016/0108923 A1 Apr. 21, 2016

(30) Foreign Application Priority Data

May 24, 2013 (DE) ..... 10 2013 008 795

(51) Int. Cl.
*F04D 25/06* (2006.01)
*F04D 13/02* (2006.01)
(Continued)

(52) U.S. Cl.
CPC ..... *F04D 25/06* (2013.01); *F04D 13/024* (2013.01); *F04D 13/025* (2013.01);
(Continued)

(58) Field of Classification Search
CPC ..... F04D 25/06; F04D 13/024; F04D 13/025; F04D 13/026; F04D 17/10; F04D 29/628; F04D 25/026
(Continued)

(56) References Cited

U.S. PATENT DOCUMENTS 2,970,548 A * 2/1961 Vilhelm ..... H02K 5/128 310/104
3,411,450 A * 11/1968 Clifton ..... F04D 13/024 310/104
(Continued)

FOREIGN PATENT DOCUMENTS

CN 202280628 U 6/2012
CN 102808776 A 12/2012
(Continued)

OTHER PUBLICATIONS

International Search Report (PCT/ISA/210) issued in PCT Application No. PCT/EP2014/060197 dated Aug. 21, 2014 with English translation (five pages).
(Continued)

*Primary Examiner* — Kenneth J Hansen
*Assistant Examiner* — Benjamin Doyle
(74) *Attorney, Agent, or Firm* — Crowell & Moring LLP

(57) ABSTRACT

A pump arrangement, in particular a magnetic coupling pump arrangement, includes a pump housing having an interior, a split case which hermetically seals a chamber surrounded by the split case from the interior formed by the pump housing, an impeller shaft with an impeller thereon which can be driven in a rotatable manner about a rotational
(Continued)

axis, an inner rotor arranged at an end of the impeller shaft opposite the impeller end, an outer rotor which interacts with the inner rotor, and an adapter element which connects the split case to the pump housing or to a component paired with the pump housing, in particular a housing cover. The adapter element includes a mounting flange which rests against a support surface of the pump housing, in particular of the housing cover (4), on a face adjacent to the interior.

13 Claims, 4 Drawing Sheets

(51) Int. Cl.
*F04D 29/62* (2006.01)
*F04D 17/10* (2006.01)

(52) U.S. Cl.
CPC ..... *F04D 13/026* (2013.01); *F04D 17/10* (2013.01); *F04D 29/628* (2013.01)

(58) Field of Classification Search
USPC ..... 417/420; 310/52
See application file for complete search history.

(56) References Cited

U.S. PATENT DOCUMENTS 3,520,642 A * 7/1970 Fulton ..... H02K 49/00 310/104
3,802,804 A * 4/1974 Zimmermann ..... F04D 7/06 417/360
4,013,384 A * 3/1977 Oikawa ..... F04D 3/02 415/10
4,047,847 A * 9/1977 Oikawa ..... F04D 13/0613 417/370
4,080,112 A * 3/1978 Zimmermann ..... F04D 1/006 415/104
4,120,618 A * 10/1978 Klaus ..... F04D 1/06 310/156.26
4,557,672 A * 12/1985 Levine ..... F04D 29/20 403/354
4,722,661 A * 2/1988 Mizuno ..... F04D 13/026 310/106
4,850,818 A * 7/1989 Kotera ..... F04D 29/0413 416/241 A
4,869,654 A * 9/1989 Klaus ..... H02K 5/128 417/360
4,871,301 A * 10/1989 Buse ..... F04D 29/0413 415/175
4,998,863 A * 3/1991 Klaus ..... F04D 15/0263 417/63
5,045,026 A * 9/1991 Buse ..... F04D 13/024 417/360
5,066,200 A * 11/1991 Ooka ..... F04B 49/10 417/420
5,090,944 A * 2/1992 Kyo ..... B01F 13/0863 417/420
5,160,246 A * 11/1992 Horiuchi ..... F04D 29/0413 384/223
5,165,868 A * 11/1992 Gergets ..... F04C 2/101 417/366
5,248,245 A * 9/1993 Behnke ..... F04D 29/061 415/110
5,263,829 A * 11/1993 Gergets ..... F04C 15/0069 417/420
5,288,213 A * 2/1994 Nasr ..... F04D 13/026 417/368
5,297,940 A * 3/1994 Buse ..... F04D 15/0272 417/420
5,334,004 A * 8/1994 Lefevre ..... F01D 11/04 277/358
5,368,439 A * 11/1994 Piazza ..... F04D 29/167 415/131
5,580,216 A * 12/1996 Munsch ..... F04D 29/0413 415/122.1
5,620,314 A * 4/1997 Worton ..... F04B 9/14 417/437
5,763,973 A * 6/1998 Cramer ..... H02K 49/106 310/103
5,831,364 A * 11/1998 Buse ..... H02K 1/278 310/104
5,846,049 A * 12/1998 DuPuis ..... F04D 29/042 415/131
6,280,156 B1 * 8/2001 Wirz ..... F04D 29/0465 417/420
6,293,772 B1 * 9/2001 Brown ..... F04D 13/025 415/122.1
6,293,773 B1 * 9/2001 Doberstein ..... H02K 49/106 417/420
6,322,335 B1 * 11/2001 Shi ..... F04D 29/0413 415/172.1
6,443,710 B1 * 9/2002 Tatsukami ..... F04D 29/0413 417/365
6,997,688 B1 * 2/2006 Klein ..... F04D 29/126 417/420
7,029,246 B2 * 4/2006 Miller ..... F04C 2/101 417/420
7,057,320 B2 * 6/2006 Abordi ..... H02K 1/278 310/103
7,101,158 B2 * 9/2006 Hembree ..... F04D 13/025 417/420
7,137,793 B2 * 11/2006 Shafer ..... F04C 2/101 417/420
7,284,961 B2 * 10/2007 Jacobsen ..... F04B 9/125 417/399
7,549,205 B2 * 6/2009 Shafer ..... H02K 49/106 29/446
8,985,969 B2 * 3/2015 Hoshi ..... F04D 13/02 417/360
2002/0054820 A1 * 5/2002 Fukamachi ..... F04D 13/027 417/420
2003/0132003 A1 * 7/2003 Arauz ..... E21B 43/128 166/370
2004/0223864 A1 * 11/2004 Miller ..... F04C 2/101 417/420
2005/0019182 A1 * 1/2005 Klein ..... F04D 29/026 417/420
2005/0142003 A1 * 6/2005 Hembree ..... F04D 13/025 417/365
2011/0217193 A1 * 9/2011 Wang ..... F04D 13/08 417/423.3
2013/0121817 A1 * 5/2013 Boehm ..... F04D 29/026 415/203
2014/0023535 A1 * 1/2014 Hoshi ..... F04D 13/025 417/420
2014/0064987 A1 * 3/2014 Cox, Jr. ..... F04D 13/0666 417/53
2014/0186203 A1 * 7/2014 Hoshi ..... F04D 13/0633 417/420
2014/0271270 A1 * 9/2014 Pierce ..... F04D 29/0413 417/405
2014/0271285 A1 * 9/2014 McDougall ..... F04D 13/0666 417/423.1
2016/0108923 A1 * 4/2016 Drechsel ..... F04D 13/025 417/420

FOREIGN PATENT DOCUMENTS

DE 3608230 A1 * 9/1987 ..... F04D 29/628
DE 43 43 854 A1 7/1995
DE 44 38 132 A1 5/1996
DE 297 16 110 U1 1/1999
DE 203 15 241 U1 12/2003
DE 10 2004 003 400 A1 8/2005
EP 0 814 268 A1 12/1997

(56) References Cited

FOREIGN PATENT DOCUMENTS

| | | | |
|---|---|---|---|
| GB | 994322 | A | 6/1965 |
| JP | H10-174362 | A | 6/1998 |

OTHER PUBLICATIONS

German-language Written Opinion (PCT/ISA/237) issued in PCT Application No. PCT/EP2014/060197 dated Aug. 21, 2014 (five pages).
German Office Action issued in corresponding German Application No. 10 2013 008 795.3 dated Nov. 12, 2013 (five pages).
German Office Action issued in corresponding German Application No. 10 2013 008 795.3 dated Apr. 1, 2014 (four pages).
International Preliminary Report on Patentability (PCT/IB/373) issued in PCT Application No. PCT/EP2014/060197 dated May 19, 2014, including English translation of document C2 (German-language Written Opinion (PCT/ISA/237)) previously filed on Nov. 23, 2015 (seven pages).
English translation of Japanese-language Office Action issued in counterpart Japanese Application No. 2016-514350 dated Feb. 27, 2018 (four (4) pages).
German-language partial European Search Report issued in counterpart European Application No. 14 726 122.6 dated May 10, 2019 (three (3) pages).
Machine English translation of previously submitted reference CN102808776, filed May 30, 2019.
Machine English translation of previously submitted reference CN202280628, filed May 30, 2019.

* cited by examiner

PUMP ARRANGEMENT FOR DRIVING AN IMPELLER USING AN INNER ROTOR WHICH INTERACTS WITH AN OUTER ROTOR AND THE OUTER ROTOR HAVING A RADIALLY OUTER CIRCUMFERENTIAL PROJECTION

CROSS REFERENCE TO RELATED APPLICATIONS

This application is a continuation of PCT International Application No. PCT/EP2014/060197, filed May 19, 2014, which claims priority under 35 U.S.C. § 119 from German Patent Application No. 10 2013 008 795.3, filed May 24, 2013, the entire disclosures of which are herein expressly incorporated by reference.

BACKGROUND AND SUMMARY OF THE INVENTION

The invention relates to a pump arrangement, in particular a magnetic clutch pump arrangement, having an interior space formed by a pump casing of the pump arrangement, having a containment can which hermetically seals off a chamber surrounded by said containment can with respect to the interior space formed by the pump casing, having an impeller shaft which can be driven in rotation about an axis of rotation, having an impeller which is arranged on one end of the impeller shaft, having an inner rotor arranged on the other end of the impeller shaft, and having an outer rotor which interacts with the inner rotor.

A pump arrangement of said type is known from German patent publication no. DE 10 2004 003 400 A1. In order to increase the range of use, this pump arrangement has a drive rotor formed as an identical part for outer drive elements. This however permits an increase in the range of use only to a particular degree. Above a certain structural size, an adaptation of the rotor size is unavoidable.

European patent publication no. EP 0 814 268 A1 has disclosed a modular construction kit for producing pumps, which modular construction kit is intended to afford the possibility of producing pumps in any desired manner from a small number of structural elements in accordance with the usage requirements. The proposed solution however permits only an exchange of components associated with a single structural size.

The documents cited above however do not take into consideration that, owing to different rotational speeds, delivery heights, delivery volumes and densities of the medium to be delivered, a large range of torques is required for a given hydraulic size.

It is an object of the invention to provide a magnetic clutch pump arrangement in which as large as possible a number of magnetic clutches with different diameters is available for one hydraulic size, and the greatest possible number of different hydraulic sizes can be used for one magnetic clutch size. It is likewise the intention for different containment cans, that is to say different pressure stages and/or materials, to be able to be used within one magnetic clutch size.

This object of the invention is achieved by an adapter element which connects the containment can to the pump casing or to a component assigned to the pump casing, in particular to a casing cover, the adapter element having a mounting flange which, at the side close to the interior space, bears against an abutment surface of the pump casing, in particular of the casing cover.

Through the use of different adapter elements, a modular construction kit is made available which permits efficient structural size configuration for one hydraulic size with different magnetic clutch sizes, or for one magnetic clutch size and different hydraulic sizes.

It is thus possible in a simple manner, by adaptation of the adapter element in terms of shape and/or size, to adapt a magnetic clutch size to different hydraulic sizes. The large range of torques required for the same hydraulic size owing to different rotational speeds, delivery heights, delivery volumes and densities of the medium to be delivered is covered in this way. It is no longer necessary to use the maximum clutch size for all combinations; rather, it is possible in each case for the suitable magnetic clutch size to be adapted to a hydraulic size, with corresponding advantages with regard to energy efficiency, eddy current losses and/or procurement costs. A further advantage of the invention is the reduced number of components that have to be stocked for a pump type series.

In a further refinement, the abutment surface has a region which is recessed in an axial direction and into which a centering ring formed on the mounting flange engages. It is firstly possible for a seal ring to be arranged in the recessed region, and secondly, the adapter element can be aligned exactly and fastened in fluid-tight fashion to the casing cover.

By virtue of the fact that, on the side situated opposite the mounting flange, the adapter element has multiple threaded holes for the fastening of the containment can, it is possible, within one magnetic clutch size, to use or interchange different containment cans of different pressure stages or strengths and/or different materials.

According to the invention, on the side situated opposite the mounting flange, a ring is provided which extends further in the axial direction into the interior space, which ring forms a run-on safeguard and prevents contact between the outer rotor and the containment can.

To improve the flow guidance of the medium, and for easier and thus cheaper production by casting, the outer contour of the adapter element has a substantially conical profile.

Here, the adapter element preferably narrows, substantially proceeding from the mounting flange toward the ring.

In a further refinement, it is provided that that end of the outer rotor which points in the direction of the casing cover has a radially encircling projection. In this way, the radial spacing of the outer rotor to the ring for normal operation can be produced in an exact manner.

For the same reason, alternatively or in addition, the projection may be formed on the inner side of the ring.

In a further exemplary embodiment of the invention, it is provided that the end of the outer rotor which points in the direction of the casing cover has a region of reduced outer diameter. The mounting capability of the adapter element in the case of small clutch diameters is thus ensured.

In a further advantageous refinement, between the impeller and inner rotor, there is arranged a bearing arrangement which is operatively connected to the impeller shaft, which can be driven rotatably about the axis of rotation.

In the context of the invention, it is proposed that, in a further embodiment, a spring device is arranged between the inner rotor and the bearing arrangement.

According to the invention, in one embodiment, between the spring device and the inner rotor, there is situated a spacer sleeve, which is pushed onto the impeller shaft and by means of which the inner rotor extends deeper into the outer rotor in an axial direction. Thus, the magnets of the inner rotor and the magnets of the outer rotor are optimally aligned with respect to one another in order to ensure an optimum transmission of power from the outer rotor to the inner rotor.

Other objects, advantages and novel features of the present invention will become apparent from the following detailed description of one or more preferred embodiments when considered in conjunction with the accompanying drawings.

DETAILED DESCRIPTION

Figure 1:
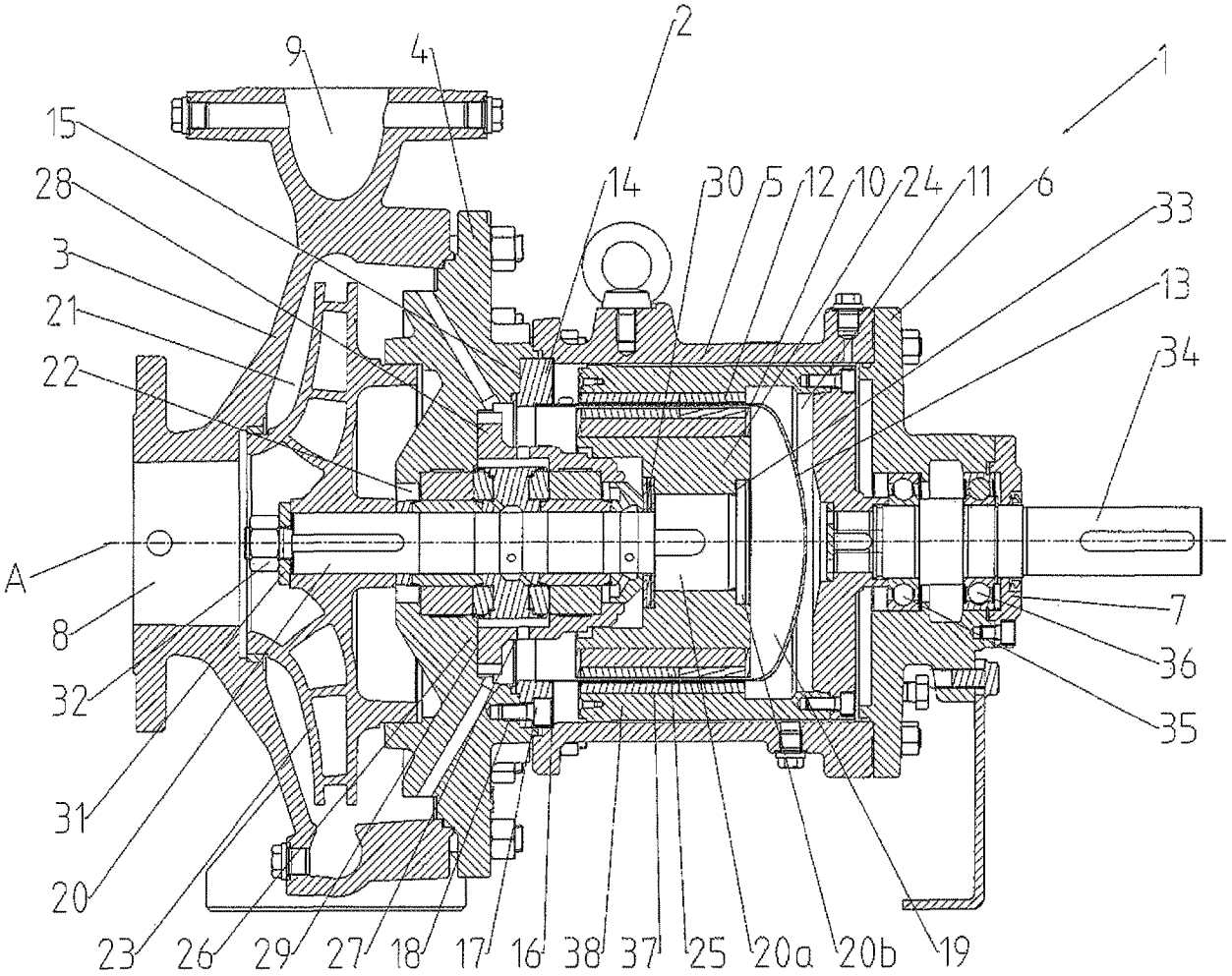
FIG. 1 shows the longitudinal section through a magnetic clutch pump arrangement in accordance with an embodiment of the invention.

FIG. 1 shows a pump arrangement 1 in the form of a magnetic clutch pump arrangement. The pump arrangement 1 has a multi-part pump casing 2 of a centrifugal pump, which pump casing comprises a hydraulics casing 3 in the form of a spiral casing, a casing cover 4, a bearing carrier cage 5, a bearing carrier 6 and a bearing cover 7.

The hydraulics casing 3 has an inlet opening 8 for the intake of a delivery medium and has an outlet opening 9 for the discharge of the delivery medium. The casing cover 4 is arranged on that side of the hydraulics casing 3 which is situated opposite the inlet opening 8. The bearing carrier cage 5 is fastened to that side of the casing cover 4 which is averted from the hydraulics casing 3. The bearing carrier 6 is mounted on that side of the bearing carrier cage 5 which is situated opposite the casing cover 4. The bearing cover 7 in turn is fastened to that side of the bearing carrier 6 which is averted from the bearing carrier cage 5.

A containment can 10 is fastened to that side of the casing cover 4 which is averted from the hydraulics casing 3, and said containment can extends at least partially through an interior space 11 delimited by the pump casing 2, in particular by the casing cover 4, by the bearing carrier cage 5 and by the bearing carrier 6. The containment can 10 has a substantially cylindrical main body 12. The main body 12 is open on one side and is closed by way of a domed base 13 on the side situated opposite the open side. At the open side there is arranged a ring-shaped fastening flange 14 which is formed integrally with the main body 12 or which is connected to said main body by welding or by way of other suitable fastening means or devices, for example screws, rivets or the like. The fastening flange 14 bears, at the side close to the interior space 11, against an abutment surface 15 of the casing cover 4, and has multiple installation holes 16 through which screws 17 can be passed and screwed into threaded bores 18 provided in the casing cover 4. The containment can 10 hermetically seals off a chamber 19, which is enclosed by said containment can and by the casing cover 4, with respect to the interior space 11.

An impeller shaft 20 which is rotatable about an axis of rotation A extends from a flow chamber 21, which is delimited by the hydraulics casing 3 and by the casing cover 4, into the chamber 19 through an opening 22 provided in the casing cover 4. An impeller 23 is fastened to a shaft end, situated within the flow chamber 21, of the impeller shaft 20, and an inner rotor 24 arranged within the chamber 19 is provided on the opposite shaft end, which has two shaft sections 20*a*, 20*b* with increasing diameters in each case. The inner rotor 24 is equipped with multiple magnets 25 which are arranged on that side of the inner rotor 24 which faces toward the containment can 10.

Between the impeller 23 and the inner rotor 24 there is arranged a bearing arrangement 26 which is operatively connected to the impeller shaft 20, which can be driven in rotation about the axis of rotation A. A bearing ring carrier 27, which is arranged coaxially with respect to the axis of rotation A and by means of which the static parts, that is to say the parts which do not rotate with the impeller shaft 20, of the bearing arrangement 26 are held in place, bears by way of a flange-like region 28 against a further abutment surface 29 of the casing cover 4, is fastened by way of a screw connection (not illustrated) to the casing cover 4, and extends into the chamber 19.

Between the inner rotor 24 or the shaft section 20*a* and the bearing arrangement 26, in particular those parts of the bearing arrangement 26 which rotate with the impeller shaft 20, there is arranged a spring device 30 in the form of a plate spring pack, which spring device exerts a spring force on the clamped assembly composed of impeller 23, an impeller nut 32 which fastens the impeller 23 to the impeller shaft 20 via a disk 31, those parts of the bearing arrangement 26 which rotate with the impeller shaft 20, and the inner rotor 24, in such a way that the clamped assembly is held in abutment, in particular by way of the inner rotor 24, with a certain degree of elasticity against an abutment surface 33 which arises owing to the different diameters of the shaft sections 20*a* and 20*b*, wherein the diameter of the shaft section 20*b* is greater than the diameter of the shaft section 20*a*. The clamped assembly thus comprises substantially the components which rotate with the impeller shaft 20 about the axis of rotation A.

A drive motor, preferably an electric motor, which is not illustrated drives a drive shaft 34. The drive shaft 34, which can be driven about the axis of rotation A, is arranged substantially coaxially with respect to the impeller shaft 20. The drive shaft 34 extends through the bearing cover 7, through the bearing carrier 6, and at least partially into the bearing carrier cage 5. The drive shaft 34 is mounted in two ball bearings 35, 36 which are accommodated in the bearing carrier 6. On the free end of the drive shaft 34 there is arranged an outer rotor 38, which bears multiple magnets 37. The magnets 37 are arranged on that side of the outer rotor 38 which faces toward the containment can 10. The outer rotor 38 extends at least partially over the containment can 10 and interacts with the inner rotor 24 such that the rotating outer rotor 38, by way of magnetic forces, sets the inner rotor 24 and thus likewise the impeller shaft 20 and the impeller 23 in rotation.

Figure 2:
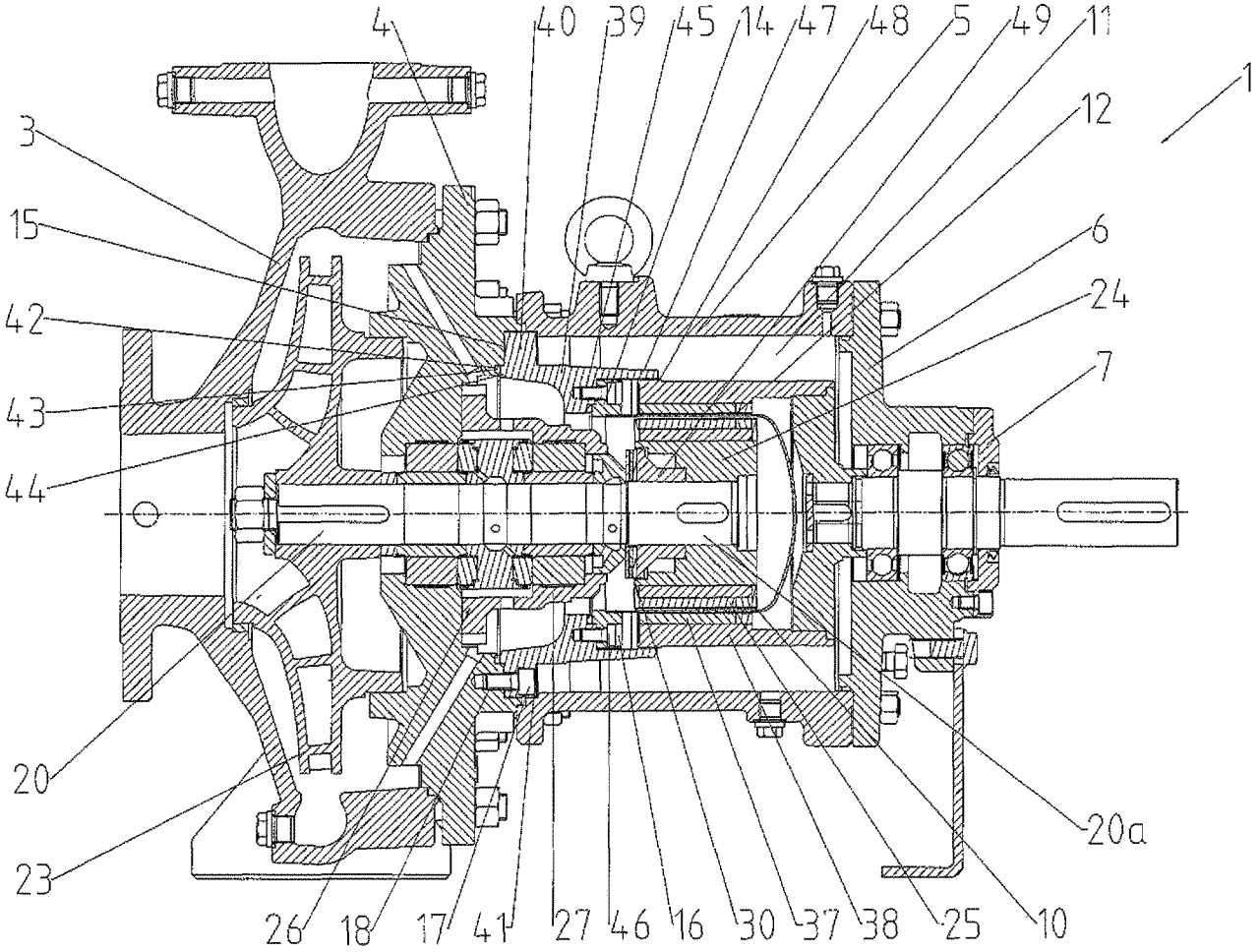
FIG. 2 shows the longitudinal section through the magnetic clutch pump arrangement as per FIG. 1 with an adapter element according to an embodiment of the invention.

FIG. 2 shows a pump arrangement 1, the outer dimensions of which correspond to the outer dimensions shown in FIG. 1. In accordance with a construction kit principle, the hydraulics casing 3, casing cover 4, bearing carrier cage 5, bearing carrier 6 and bearing 7 are thus of the same dimensions. Furthermore, in both embodiments, the impeller 23, bearing arrangement 26 and bearing ring carrier 27 are of the same dimensions. In the embodiment shown in FIG.

2, both the diameter and axial extent of containment can 10, inner rotor 24 and outer rotor 38 are smaller than in the embodiment shown in FIG. 1. This is particularly advantageous if lower power demands, for example a lower delivery height or delivery flow rate, with the highest possible efficiency, are placed on the pump arrangement 1.

To adapt the containment can 10 with reduced axial extent and reduced diameter, a separate adapter element 39 is provided which, on one side, has a mounting flange 40, the design of which substantially corresponds to the design of the fastening flange 14 of the containment can 10 as shown in FIG. 1. At the side close to the interior space 11, the mounting flange 40 bears against the abutment surface 15 of the casing cover 4 and has multiple installation holes 41, through which the screws 17 can be passed and screwed into threaded bores 18 provided in the casing cover 4. The abutment surface 15 has a region 42 which is recessed in an axial direction and in which a seal ring 43 is arranged and into which a centering ring 44 formed on the mounting flange 40 engages, whereby the adapter element 39 can be fastened in an exactly aligned and fluid-tight manner to the casing cover 4.

On the side situated opposite the mounting flange 40, the adapter element 39 has multiple threaded holes 45 into which there can be screwed screws 46 which extends through the installation holes 16 in the fastening flange 14 of the containment can 10. It is thereby possible, within a magnetic clutch size, to interchange different containment cans 10 of different pressure stages or strengths and/or different materials. Furthermore, on the side situated opposite the mounting flange 40, there is provided a ring 47 which extends further in an axial direction into the interior space 11, which ring forms a run-on safeguard and prevents contact between the magnets 37 of the outer rotor 38 and the main body 12 of the containment can 10. The outer contour of the adapter element 39 has in each case a substantially conical profile. Here, proceeding substantially from the mounting flange 40, the adapter element 39 narrows toward the ring 47. The inner contour of the adapter element 39 is at least partially of narrowing form. In the embodiment illustrated in FIG. 2, that end of the outer rotor 38 which points in the direction of the casing cover 4 has a radially encircling projection 48 facing toward the ring 47, which projection, in the possible case of an outer rotor 38 rotating with an imbalance, makes contact firstly with the inner side of the ring 47 of the adapter element 39 before the magnets 37 of the outer rotor 38 come into contact with the main body 12 of the containment can 10. In an alternative embodiment, the projection 48 may also be formed on the inner side of the ring 47. In a further embodiment, the projection 48 may be formed both on the end of the outer rotor 38 and on the inner side of the ring 47.

Between the spring device 30 and the inner rotor 24 there is situated a spacer sleeve 49 which is pushed onto the impeller shaft 20, and which expands the above-described clamped assembly by this component. In the embodiment shown, the impeller shaft 20, in particular shaft section 20*a*, is lengthened in relation to the embodiment shown in FIG. 1 by the length of the spacer sleeve 49. By means of the spacer sleeve 49, the inner rotor 24 extends deeper into the outer rotor 38 in the axial direction. In this way, the magnets 25 of the inner rotor 24 and the magnets 37 of the outer rotor 38 are optimally aligned with respect to one another in order to ensure an optimum transmission of power from the outer rotor 38 to the inner rotor 24.

Figure 3:
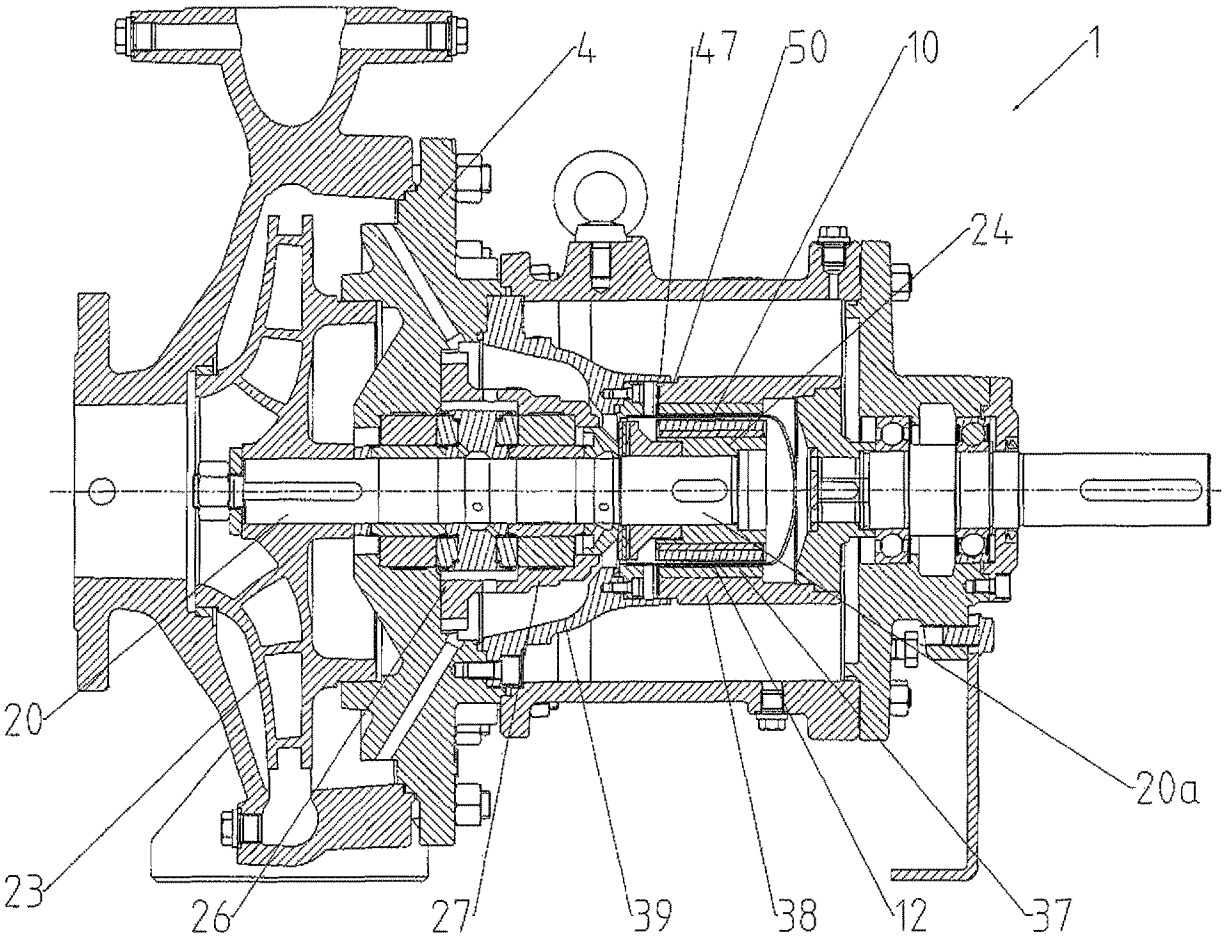
FIG. 3 shows the longitudinal section through the magnetic clutch pump arrangement as per FIG. 1 with a further adapter element according to an embodiment of the invention.

FIG. 3 shows a pump arrangement 1, the outer dimensions of which correspond to the outer dimensions shown in FIGS. 1 and 2. Likewise, the impeller 23, bearing arrangement 26 and bearing ring carrier 27 are of the same dimensions as in the embodiment shown in FIGS. 1 and 2. In the embodiment shown in FIG. 3, both the diameter and the axial extent of the containment can 10, inner rotor 24 and outer rotor 38 have been reduced further in relation to the embodiment shown in FIG. 2. The impeller shaft 20, in particular shaft section 20*a*, has the same axial extent as in the embodiment shown in FIG. 2. That end of the outer rotor 38 which points in the direction of the casing cover 4 has a region 50, facing toward the ring 47, of reduced outer diameter, wherein an outer rotor 38, in the possible event of it rotating with an imbalance, comes into contact with the inner side of the ring 47 of the adapter element 39 by way of said region 50 first, before the magnets 37 of the outer rotor 38 come into contact with the main body 12 of the containment can 10.

Figure 4:
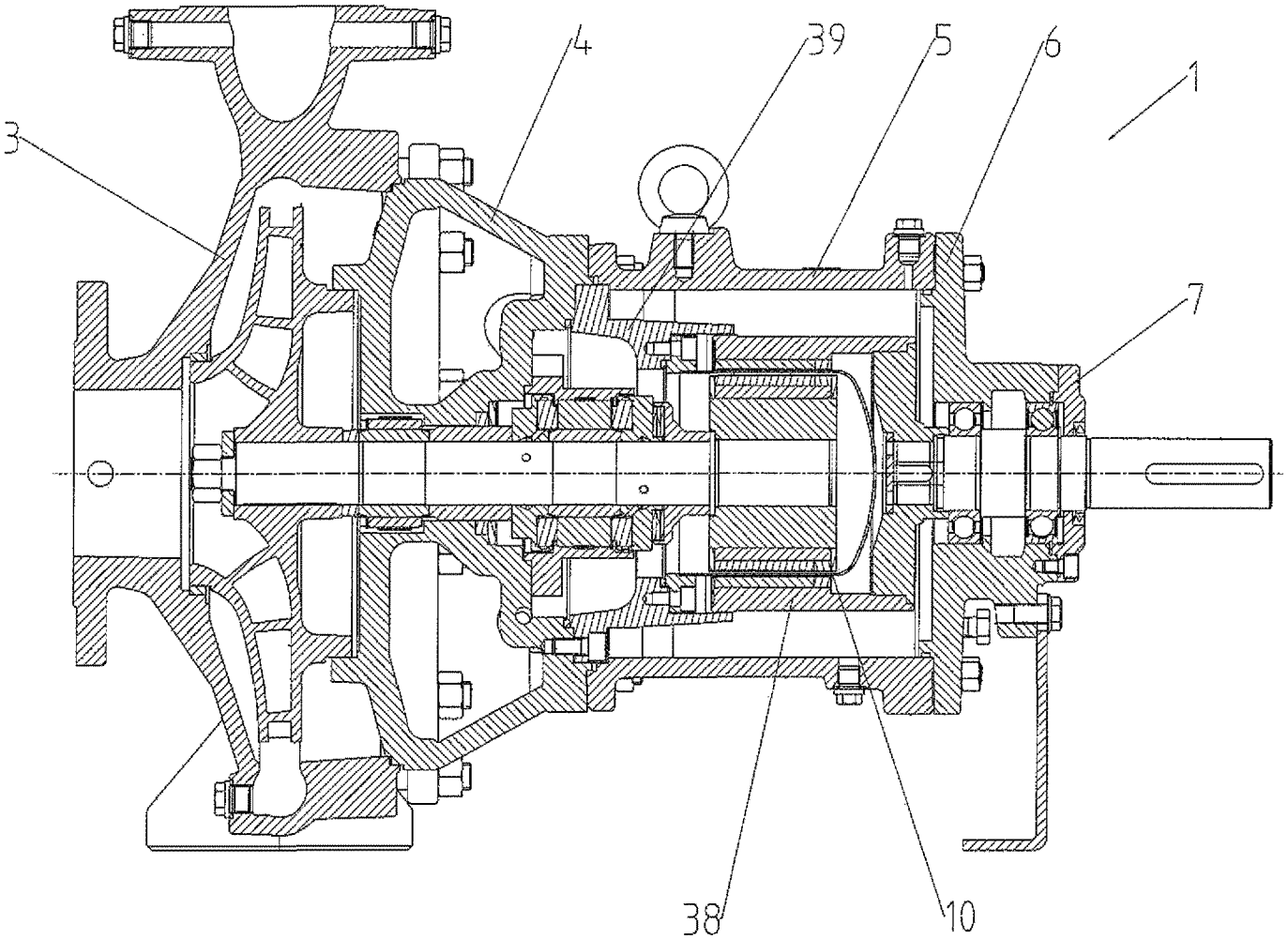
FIG. 4 shows the longitudinal section through a magnetic clutch pump arrangement with a casing cover which serves as a heat barrier, and with an adapter element according to the invention in FIG. 2.

As can be seen from FIG. 4, the adapter element 39 may also be used on a casing cover 4, formed as a heat barrier, in a pump arrangement 1 which conducts a hot medium. Here, the hydraulics casing 3, major regions of the casing cover 4, the bearing carrier cage 5, the bearing carrier 6 and the bearing cover 7 are of the same dimensions as in the exemplary embodiments shown in FIGS. 1 to 3. The containment can 10, the adapter element 39 and the outer rotor 38 are of the same dimensions, correspondingly to the magnetic clutch size as per FIG. 2.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE DESIGNATIONS

1 Pump arrangement
2 Pump casing
3 Hydraulics casing
4 Casing cover
5 Bearing carrier cage
6 Bearing carrier
7 Bearing cover
8 Inlet opening
9 Outlet opening
10 Containment can
11 Interior space
12 Main body
13 Base
14 Fastening flange
15 Abutment surface
16 Installation hole
17 Screw
18 Threaded bore
19 Chamber
20 Impeller shaft
20*a* Shaft section
20*b* Shaft section
21 Flow chamber
22 Opening
23 Impeller
24 Inner rotor
25 Magnet
26 Bearing arrangement
27 Bearing ring carrier

28 Flange-like region
29 Abutment surface
30 Spring device
31 Disk
32 Impeller nut
33 Abutment surface
34 Drive shaft
35 Ball bearing
36 Ball bearing
37 Magnet
38 Outer rotor
39 Adapter element
40 Mounting flange
41 Installation hole
42 Recessed region
43 Seal ring
44 Centering ring
45 Threaded hole
46 Screw
47 Ring
48 Projection
49 Spacer sleeve
50 Region of reduced outer diameter
A Axis of rotation

The invention claimed is:

1. A pump arrangement, comprising:
a pump casing having an interior space;
an impeller shaft arranged to be driven about an axis of rotation;
an impeller arranged on a first end of the impeller shaft;
an inner rotor arranged on a second end of the impeller shaft;
an outer rotor which interacts with the inner rotor;
a containment can arranged to hermetically seal off a chamber containing the inner rotor from a portion of the interior space containing the outer rotor; and
an adapter element arranged to connect the containment can to at least one of the pump casing and a component connected to the pump casing,
wherein
the adapter element includes a mounting flange arranged to bear against an abutment surface of the at least one of the pump casing and the component connected to the pump casing in a region adjacent to the impeller,
the adapter element includes a ring extending axially away from the mounting flange and concentrically surrounding at least a portion of the outer rotor, the ring being sized to radially guide the outer rotor to prevent contact between the outer rotor and the containment can, and
an end of the outer rotor facing the pump casing includes a radially outer circumferential projection configured to make contact with a radially inner surface of the adapter element ring before magnets of the outer rotor contact the containment can.

2. The pump arrangement of claim 1, wherein
the component connected to the pump casing is a casing cover.

3. The pump arrangement as claimed in claim 2, wherein
the abutment surface has a region recessed in an axial direction configured to receive a centering ring of the mounting flange.

4. The pump arrangement as claimed in claim 3, wherein
the adapter element includes a plurality of threaded holes on a side opposite the mounting flange.

5. The pump arrangement as claimed in claim 4, wherein
the adapter element ring on the side opposite the mounting flange extends further away from the mounting flange than the plurality of threaded holes.

6. The pump arrangement as claimed in claim 5, wherein
an outer contour of the adapter element has a circumference which tapers along the axis of rotation, decreasing in radius away from the casing cover.

7. The pump arrangement as claimed in claim 6, wherein
the outer contour narrows from the mounting flange toward the ring in a curved manner in at least a portion of the outer contour.

8. The pump arrangement as claimed in claim 5, wherein
a casing cover end of the outer rotor includes a region of reduced outer diameter.

9. The pump arrangement as claimed in claim 5, further comprising:
a bearing arrangement arranged concentrically about the impeller shaft axially between the impeller and inner rotor.

10. The pump arrangement as claimed in claim 9, further comprising:
a spring device is arranged concentrically about the impeller shaft axially between the inner rotor and the bearing arrangement.

11. The pump arrangement as claimed in claim 10, further comprising:
a spacer sleeve arranged concentrically about the impeller shaft axially between the spring device and the inner rotor.

12. A modular construction kit, comprising:
a pump casing having an interior space;
an impeller shaft arranged to be driven about an axis of rotation;
an impeller configured to be arranged on a first end of the impeller shaft;
an inner rotor configured to be arranged on a second end of the impeller shaft;
an outer rotor configured to interact with the inner rotor when the outer rotor and the inner rotor are in their respective installed positions;
a containment can configured to be arranged in an installed position to hermetically seal off a chamber containing the inner rotor from a portion of the interior space containing the outer rotor; and
a plurality of adapter elements, each configured to be arranged in an installed position to connect the containment can to at least one of the pump casing and a component connected to the pump casing,
wherein each of the plurality of adapter elements includes
a mounting flange configured such that when one of the plurality of adapter elements is in the installed position, the mounting flange bears against an abutment surface of the at least one of the pump casing and the component connected to the pump casing in a region adjacent to the impeller, and
a ring extending axially away from the mounting flange and configured to concentrically surround at least a portion of the outer rotor, the ring being sized to radially guide the outer rotor to prevent contact between the outer rotor and the containment can, and
wherein an end of the outer rotor facing the pump casing includes a radially outer circumferential projection at an end of the outer rotor facing the pump casing, the radially outer circumferential projection being configured to make contact with a radially inner surface of the adapter element ring before magnets of the outer rotor contact the containment can.

13. A pump arrangement, comprising:

a pump casing having an interior space;

an impeller shaft arranged to be driven about an axis of rotation;

an impeller arranged on a first end of the impeller shaft;

an inner rotor arranged on a second end of the impeller shaft;

an outer rotor which interacts with the inner rotor;

a containment can arranged to hermetically seal off a chamber containing the inner rotor from a portion of the interior space containing the outer rotor; and an adapter element arranged to connect the containment can to a component connected to the pump casing in the form of a casing cover, wherein the adapter element includes a mounting flange arranged to bear against an abutment surface of the casing cover in a region adjacent to the impeller, and a ring extending axially away from the mounting flange and concentrically surrounding at least a portion of the outer rotor, the ring being sized to radially guide the outer rotor to prevent contact between the outer rotor and the containment can, and wherein an end of the outer rotor facing the pump casing includes a radially outer circumferential projection at an end of the outer rotor facing the pump casing, the radially outer circumferential projection being configured to make contact with a radially inner surface of the adapter element ring before magnets of the outer rotor contact the containment can.

* * * * *